US005774168A

United States Patent [19]

Blome

[11] Patent Number: 5,774,168

[45] Date of Patent: Jun. 30, 1998

[54] IDENTITY CARD AND PROCESS FOR ITS PRODUCTION

[75] Inventor: Rainer Blome, Paderborn, Germany

[73] Assignee: ORGA Kartensysteme GmbH, Paderborn, Germany

[21] Appl. No.: 553,579

[22] PCT Filed: May 16, 1995

[86] PCT No.: PCT/DE95/00637

§ 371 Date: Feb. 16, 1996

§ 102(e) Date: Feb. 16, 1996

[87] PCT Pub. No.: WO95/31338

PCT Pub. Date: Nov. 23, 1995

[30] Foreign Application Priority Data

May 18, 1994 [DE] Germany ..... 44 17 343.1

[51] Int. Cl.[6] ..... B41J 2/45

[52] U.S. Cl. ..... 347/262; 347/264

[58] Field of Search ..... 547/262, 264; 346/135.1

[56] References Cited

U.S. PATENT DOCUMENTS 4,663,518 5/1987 Borror et al. ..... 235/487
4,735,670 4/1988 Maurer .
5,298,922 3/1994 Merkle et al. ..... 347/262

FOREIGN PATENT DOCUMENTS 230 497 12/1990 European Pat. Off. .
30 48 733 6/1983 Germany .
31 51 407 10/1983 Germany .
38 40 729 6/1990 Germany .
39 07 415 9/1990 Germany .

*Primary Examiner*—Mark J. Reinhart
*Attorney, Agent, or Firm*—Cohen, Pontani, Lieberman, Pavane

[57] ABSTRACT

An identity card, especially a credit card, having a picture section, which contains a photo of the card holder. In this section, pixels of different absorptions, especially the gray and black parts, are burned by a laser beam point-by-point into a surface layer and/or an intermediate layer located below a transparent surface layer of the identity card. In addition, a colored part is applied, particularly using the thermal transfer process, which covers the same area as the image. Security features can also be introduced into the image division.

13 Claims, 2 Drawing Sheets

FIG. 2A
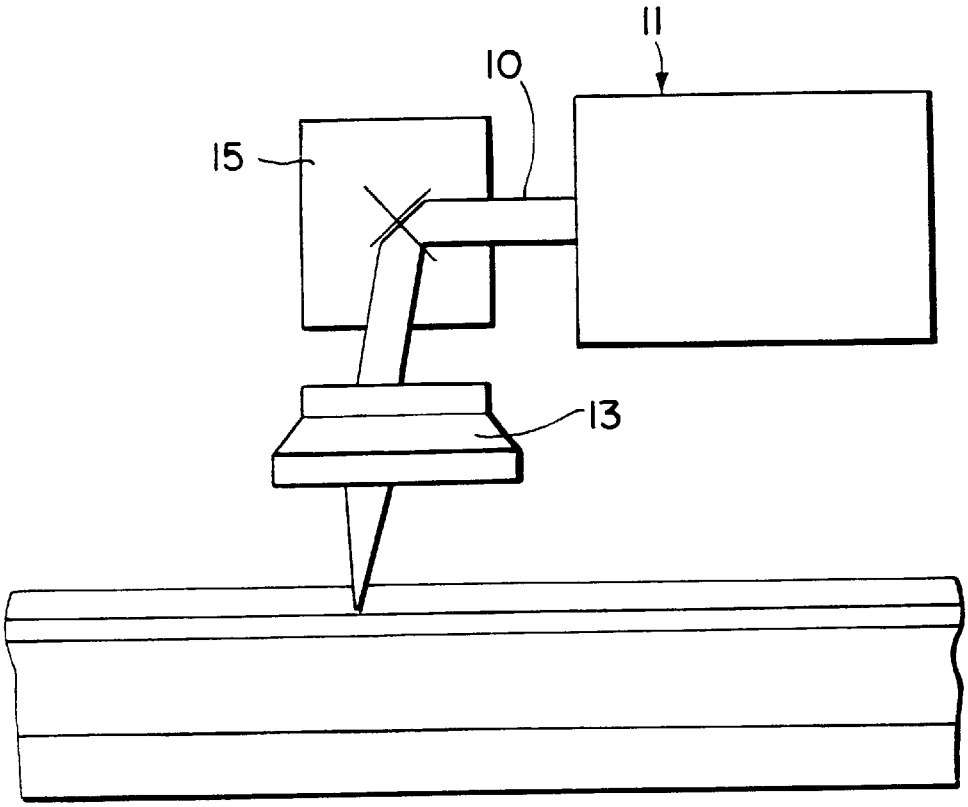
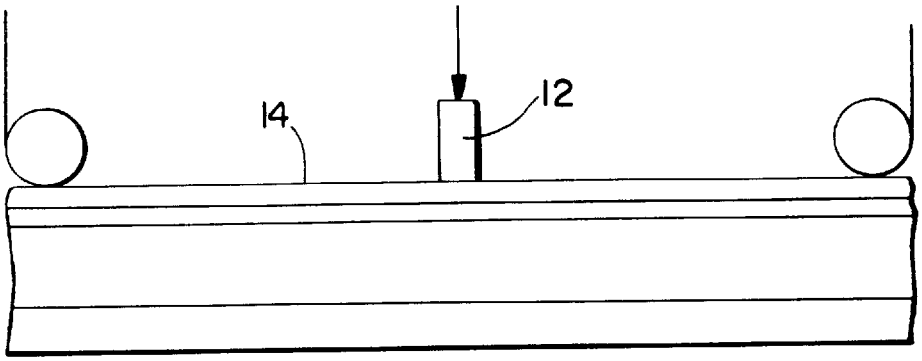
FIG. 2B

IDENTITY CARD AND PROCESS FOR ITS PRODUCTION

BACKGROUND OF THE INVENTION

1. Field of the Invention

The invention relates to an identity card, especially a credit card, with a picture section that contains a photo of the person to be identified. In this picture section, pixels of various absorptions are introduced point-by-point by a laser beam into a surface layer and/or an intermediate layer located below a transparent surface layer and/or an inlet layer located below a transparent surface layer.

2. Description of the Prior Art

From DE 31 51 407, it is known to produce identity cards of this type. The pixels of an identifying picture are burned into a surface layer that is highly absorbent of the laser beam of an Nd-YAG laser or into an absorption layer located below a transparent lamination and also, as applicable, into an inlet layer. Introduction of the pixels into the layer below the transparent lamination, in particular, provides relatively good protection against counterfeiting the card. Controlling the intensity of the laser as the pixels are scanned makes it possible to attain high-quality gray-level imaging and thus black-and-white or color pictures of good quality. However, controlling the intensity with which the dots are scanned slows down the creation of the image, especially when a high pixel density is to be achieved.

From DE 39 07 415 A1, it is furthermore known to provide identity cards with a picture section that is created by thermal-transfer multi-color printing. However, in this case, a high-quality color picture is applied to the surface of the surface layer and is thus relatively easy to alter or remove and replace.

SUMMARY OF THE INVENTION

The object of the invention is to create an identity card having a high-quality color picture section that offers an increased level of security against counterfeiting, as well as a process for producing it.

Pursuant to this object, a monochromatic part and/or a gray or black part of the image is/are introduced into the identity card by use of laser technology and then a colored part of the image, which completes the image and covers the same area, is applied over the laserproduced part.

In another embodiment of the invention the laser part of the image contains the gray and black portion of the image and the color part contains essentially no gray or black portion. In still a further embodiment the laser part of the image contains a first colored portion of the image and the color part of the image contains the colored portions that complete the image, including an overlay of all colors to gray and black. Still another embodiment of the invention has an inlet layer that is white and has a surface with a light absorption property that is alterable by exposure to a laser beam. In yet another embodiment of the invention the surface layer is made of a thermoplastic which when heated can take on sublimation pigments and pigment binders.

Dividing the picture into a laser-produced part and a complementary colored part applied by thermal transfer results in an image with high color intensity, which makes very reliable identification of the person depicted in the picture possible on the basis of skin and hair color, eye color, and so on. Subjecting the card to different processing methods with highly technical equipment makes counterfeiting with widely-used color copiers and color printing techniques more difficult. Preferably, the color printing process uses sublimation inks that bind permanently with and diffuse into a suitable thermoplastic surface of the surface layer of the card. This makes counterfeiting more difficult, because the surface of the colored image remains smooth and undisturbed.

If the surface layer is prepared with material components or pigments that can be altered by laser beam, the laser-produced part of the image can be produced directly in the surface layer.

Preferably, however, the laser-produced part is introduced into an intermediate layer or into the inlet layer, which usually contains white dyestuff, and the laser energy used for this is selected so that an absorption change takes place in the deeper layer, while the transparent surface layer remains largely unchanged.

Dividing the image into two parts separated from one another in the depth of the card makes it possible to recognize counterfeited cards that lack one of the parts. The reason for this is that when the two parts of a genuine card are looked at obliquely, they appear to be staggered relative to one another and do not correlate sharply. It is even possible to heighten and exploit this effect for security purposes by producing a laser image suitably varied in intensity; for example, by using greater and lesser laser intensity in a strip-wise fashion, and then, in a reverse manner, also applying the color image so that its intensity varies in a fashion complementary in respect to the absorption range that is missing as a result. If this is done, the completed picture will appear fully normal and homogeneous when looked at vertically, but will be seen when looked at obliquely to have discolored or lightened or darkened edges along the security pattern.

Using known processes and standard materials, the laser process generally produces a black part of the picture, which extends through gray to white depending on intensity. However, when the layer to be exposed to the laser beam is suitably pigmented, it is also possible to create a monochromatic image. In particular, laser images having dark-brown discolorations are known, because brown decomposition products are often created when the dyestuffs in the inlet material are broken down. Preferably, a color component reduced in this way is used to establish the colored image, so that a normal color picture, including the black parts, is summarily created. The separate production in the laser part of the image elements having broadband absorbency makes it largely unnecessary to simultaneously overlay complementary colors in the colored part in order to produce the black portion and the color intensity there; as a result, excellent image formation is possible with relatively little ink.

BRIEF DESCRIPTION OF THE DRAWINGS

FIG. 2A schematically illustrates the componentry for subjecting the card to a laser beam; and FIG. 2B schematically illustrates a thermal transfer of color pigments to the card.

DETAILED DESCRIPTION OF THE PREFERRED EMBODIMENTS

Figure 1:
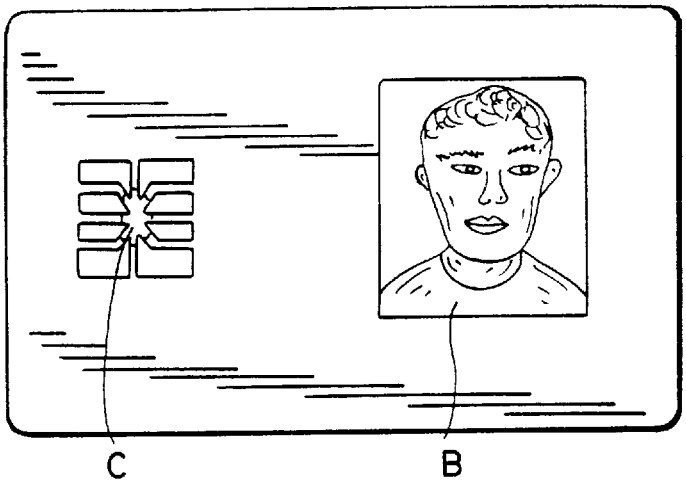
FIG. 1 is a top view of a credit card having a picture section, pursuant to the present invention.

The credit card in FIG. 1 has a section containing an information microprocessor chip (C) and an picture section (B) that displays a passport photo of the credit card holder. Further user characteristics and data can be printed on the card or stored on the card on a magnetic or optical data carrier in a conventional manner.

Figure 2:
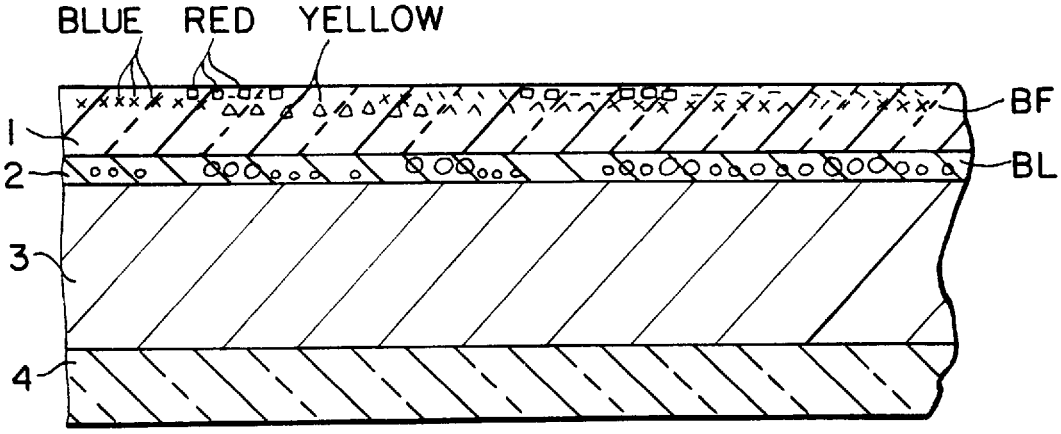
FIG. 2 is an enlarged sectional view of the picture section of the credit card.

In FIG. 2, the cross-sectional view of the picture section (B) of the credit card shows that the card is composed of multiple layers 1 to 4. The two outer layers are transparent surface layers (1, 4) made of plastic. Below the upper surface layer (1), there is an intermediate layer (2) that can be altered by laser beam (10) from a laser (11). Below the intermediate layer (2), there is an inlet layer (3) that is nontransparent and, preferably, originally white in the picture section.

The intermediate layer (2) contains a laser-produced image part (BL) that is altered in its absorption property by exposure to a laser beam (1). The surface layer (1) is provided with a colored image part (BF) by means of fusion with multiple sublimation dyestuffs, in accordance with the design of the image.

Preferably, to produce the laser part (BL) of the image, the credit card is first subjected to the laser image point-by-point in a raster-like fashion, and its absorption property is altered accordingly. The known method of laser exposure, in which the surface of the inlet layer (3) is altered in its absorption property by the laser beam, may also be used. It is known that the laser beam 10 passes from the laser 11 through a lens 13 to the card. The beam 10 is also passed through a deflection/scan-mirror device 15. In the next step, a color printing process broken down into partial steps, the colored part BF) of the image, which is preferably composed of three color components, is established little by little in precise correlation to the pixels. To do this, point-shaped electrodes of a knife-like thermal printer line 12 are heated in an electrically-controlled fashion in a known manner, so that the pigmented layer of a pigment foil 14, which is located between the thermal printer line 12 and the surface layer, is melted and/or vaporized and deposited on the surface layer (1) point-by-point. The individual colors are applied one after the other in a known manner, using either multiple color printer lines with different pigment foils or one multicolored pigment foil with alternating pigment segments. The credit card passes below the print line in reciprocating (pilger) fashion. The precisely point-correlated arrangement of the color and image parts is controlled in a known manner via a resolver on (see FIG. 2A and 2B) a card transporter and photo sensors on the color carrier strip.

If discoloration of the intermediate layer (2) or of the inlet layer (3) by the laser is foreseen, a simplifying option is to omit the color component from the colored part of the image and to work there with only two components, which simplifies the color printing. This allows even a picture that is falsified later on to be easily recognized, because the color component in the added features, which should be present in the depth of the card, will have been introduced during counterfeiting only onto the surface, assuming that the counterfeiter will generally not have access to suitable laser technology.

Instead of thermal transfer, another color application process may also be used. For example, an electrostatic-optical process originating in color copier technology and shifted to pixel production for computer printers can be used, as can the multicolor inkjet process used for computer printing.

A further advantageous embodiment of the process and the device for implementing the process includes using the same laser scanning device that is used to introduce the laser part of the image to apply the colored part of the image. To this end, the thermal transfer foil is placed into close contact with the card surface, whereupon the laser beam, controlled by the color data, scans the picture field.

This process is repeated for the different colors one after the other. The pigment foil can be pressed by a support made of a transparent material, especially glass, while the card is pressed from behind by an elastic counter-holding device. The hold-down device can be designed as a plate over its entire area, or as a lineal, such as a glass rod. With a linear design, movement on the pigment foil, for example, rolling, takes place in one image axis, and the laser beam is deflected only vertically to this in the direction of the rod and transmitted through the rod, which acts as a lens.

Using the same laser to produce the colored image simplifies the device and its control and results in extraordinary precision in the spatial correlation of image and color, because the same positioning means are used in each case. Furthermore, the process of producing the colored image is speeded up, compared to pigment transfer with electrically-heated pixels, because in the latter case it is necessary to wait for pixels to cool between sequential lines and because the pixel line must be mechanically transported to the next line position, determining the shortest time needed for image composition. Instead of pressing the pigment foil by a support, it is also possible to tighten the foil, which causes the elastic card to become deformed in a curved fashion at least in the picture section and thus ensures full surface contact with the foil. The arrangement described here and the process for producing a color transfer picture by heating the pixels with a laser beam is an independent invention, which is significant independent of the production of a laser beam in the depth of the card.

I claim:

1. An identity card comprising a picture section which contains an image of a person, the picture section be formed of a surface layer, an intermediate layer below the surface layer, and an inlet layer below the intermediate layer, at least one of the surface layer, the intermediate layer and the inlet layer having pixels therein that have different levels of light absorption and are introduced point-by-point by a laser beam to create the image, the picture section further including a laser image part and a color image part arranged above the laser image part, the laser image part and the color image part cooperating to form a total image of the person, the color image part being devoid of one of a gray portion, a black portion and a color necessary to complete the total image, the laser image part having at least one of a gray portion, a black portion and the color necessary to complete the total image.

2. An identity card as defined in claim 1, wherein the surface layer is transparent.

3. An identity card as defined in claim 1, wherein the laser part of the image contains a gray and black portion of the image and the color part contains substantially no gray or black portion.

4. An identity card as defined in claim 1, wherein the laser part of the image contains further a first colored portion of the image and the color part of the image contains colored portions that complete the image, including an overlay of all colors to gray and black.

5. An identity card as defined in claim 1, wherein the laser part of the image varies in its intensity in a pre-established pattern and the color part of the image varies in its intensity and complimentary to the laser part so that when viewed from above orthogonal to the image the total image is visible and when viewed from the side the pre-established pattern is visible.

6. An identity card as defined in claim 1, wherein the intermediate layer is optically alterable by exposure to a laser beam.

7. An identity card as defined in claim 6, wherein the intermediate layer includes a pigment that is optically alterable by exposure to a laser beam.

8. An identity card as defined in claim 6, wherein the intermediate layer includes a material share that is optically alterable by exposure to a laser beam.

9. An identity card as defined in claim 1, wherein the inlet layer is white and has a surface with a light absorption property that is alterable by exposure to the laser beam.

10. An identity card as defined in claim 1, wherein the surface layer consists of a thermoplastic which when heated takes on sublimation pigments and pigment binders.

11. An identity card as defined in claim 1, wherein the color image part is in the surface layer and the laser image part is in the intermediate layer.

12. A process for producing an identity card having a picture section with an image of a person, comprising the steps of:

providing a picture section having a surface layer, an intermediate layer below the surface layer, and an inlet layer below the intermediate layer;

splitting color intensity values of pixels of a color image to be introduced into the picture section into an intensity value portion and a color intensity value portion;

exposing the identity card to a laser beam using a laser scanning device based upon the intensity value portion to produce a laser part of the color image in the card; and producing and controlling a thermal transfer color image of different colors using the color intensity value portion, separated according to color, so that different thermal transfer pigments are applied to the identity card one after another relative to the laser part so as to produce the image.

13. A process as defined in claim 12, wherein the step of producing a thermal transfer color image includes pressing one thermal transfer pigment foil with a thermal transfer pigment against a surface of the card for each of the different colors of the color image, in sequence, and heating corresponding color pixels with the laser beam in a controlled manner according to the color intensity value portion for transferring the pigments onto and into the card surface.

* * * * *